US005920525A

United States Patent [19]

Kuo

[11] Patent Number: 5,920,525

[45] Date of Patent: Jul. 6, 1999

[54] ALARM CLOCK PROVIDED WITH MEANS FOR CONTROL OF BUZZING AND OTHER ACTIONS THEREOF

[76] Inventor: Chu-Rong Kuo, 12F, No. 367, Han Kou Road, Sec. 4, Taichung, Taiwan

[21] Appl. No.: 09/217,570

[22] Filed: Dec. 21, 1998

[51] Int. Cl.[6] ..... G94B 23/00

[52] U.S. Cl. ..... 368/250; 368/262

[58] Field of Search ..... 368/73–75, 250, 368/254, 257, 262–263, 269

[56] References Cited

U.S. PATENT DOCUMENTS

| | | | |
|---|---|---|---|
| 4,449,833 | 5/1984 | Montgomery | 368/262 |
| 4,747,087 | 5/1988 | Sakuma | 368/262 |
| 5,229,982 | 7/1993 | Kuo | 368/262 |
| 5,757,732 | 5/1998 | Kuo | 368/262 |

*Primary Examiner*—Vit Miska
*Attorney, Agent, or Firm*—Browdy and Neimark

[57] ABSTRACT

An alarm clock is composed of a housing provided with a chamber, a machine core located in the chamber, a loud speaker located in the chamber, an opening and closing device having at least one door, a magnet and an arresting rod, a touch control set connected with a circuit unit disposed in the chamber, a magnetic sensor disposed in the housing such that the magnetic sensor is opposite to the magnet of the opening and closing device. The magnetic sensor has a relay connected with the circuit unit, and an electromagnet disposed in the relay. The alarm clock is further composed of an action member which is provided at one end thereof with a pivot and at other end thereof with a magnet which is capable of moving to be corresponding in location to the magnetic sensor at the time when the action member turns around the center of the pivot.

6 Claims, 5 Drawing Sheets

ALARM CLOCK PROVIDED WITH MEANS FOR CONTROL OF BUZZING AND OTHER ACTIONS THEREOF

FIELD OF THE INVENTION

The present invention relates generally to an alarm clock, and more particularly to an alarm clock which is provided with a switching device for controlling the buzzing and other actions of component parts of the alarm clock.

BACKGROUND OF THE INVENTION

The conventional alarm clock can be set to ring at any particular time by means of a spring and a hammer which is actuated to hit a metal bell, so as to awaken a person. Such a conventional alarm clock as described above works by a mechanical transmission and thus has a large volume. In addition, the sound of ring bell is rather monotonous.

The electronic alarm clock is provided with a press switch for controlling the sounding or the buzzing of the alarm clock. The sounding or the buzzing is brought about by the electronic sound imitator or the quartz oscillator. The electronic alarm clock is therefore more interesting than the mechanical alarm clock; nevertheless the electronic alarm clock still lacks dynamic attraction.

SUMMARY OF THE INVENTION

It is therefore the primary objective of the present invention to provide an alarm clock with a swiveling device capable of actuating an article to swivel and produce the sound so as to make the alarm clock more interesting.

It is another objective of the present invention to provide an alarm clock with one or two doors for controlling the sounding or the buzzing of the alarm clock.

In keeping with the principle of the present invention, the foregoing objectives of the present invention are attained by an alarm clock consisting of a machine core, a speaker, a circuit unit, an opening and closing device, a touch control set, a magnetic sensor, and an action unit. The front housing of the alarm clock is provided with two doors opposite to a magnet and an arresting rod. The circuit unit is triggered at the set time to actuate the magnetic sensor to bring about a magnetic field to cause the doors to open so as to effect the sounding or the buzzing. In the meantime, the power interruption causes the action member of the action unit to swivel back and forth.

The foregoing objectives, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
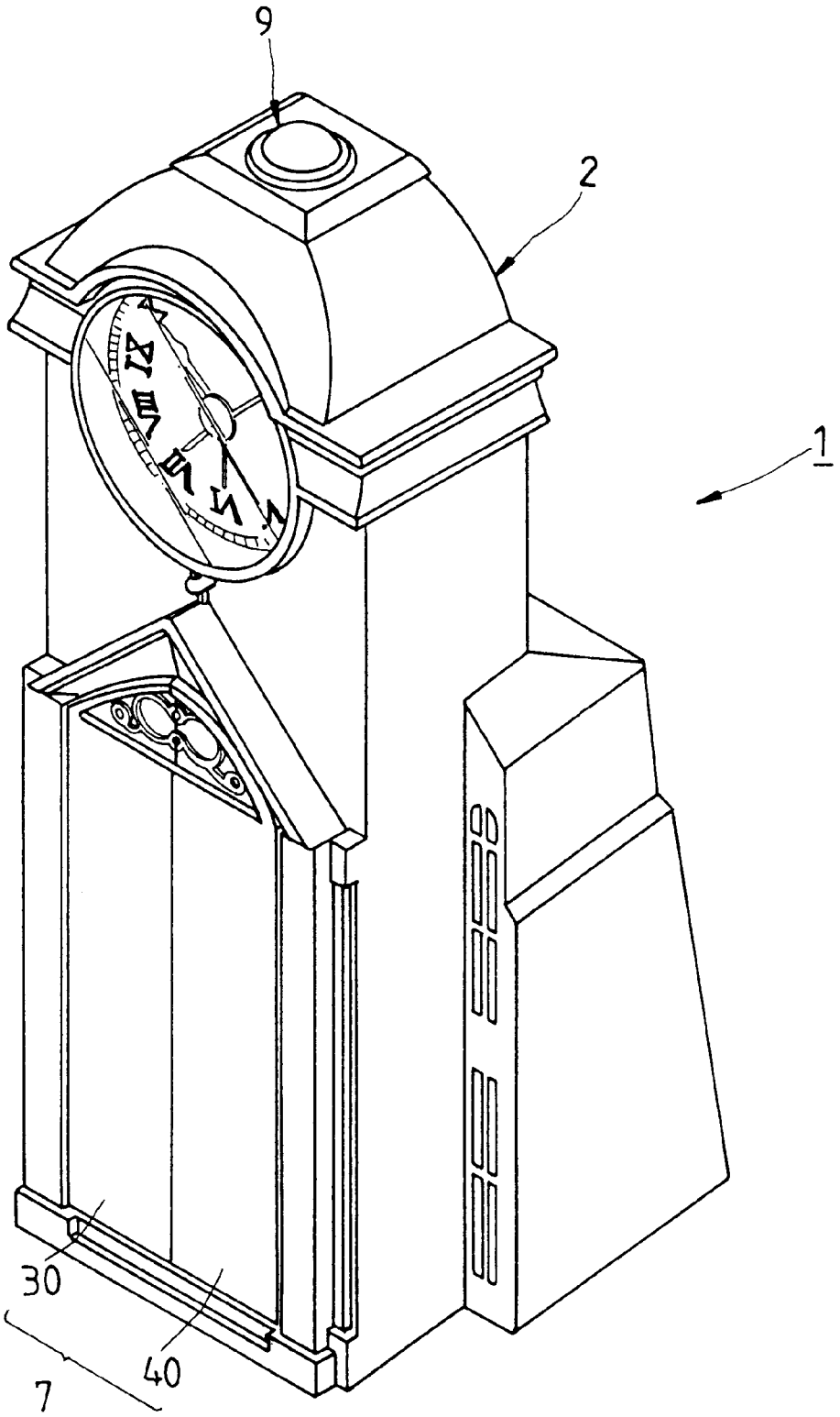
FIG. 1 shows a perspective view of the preferred embodiment of the present invention.
Figure 2:
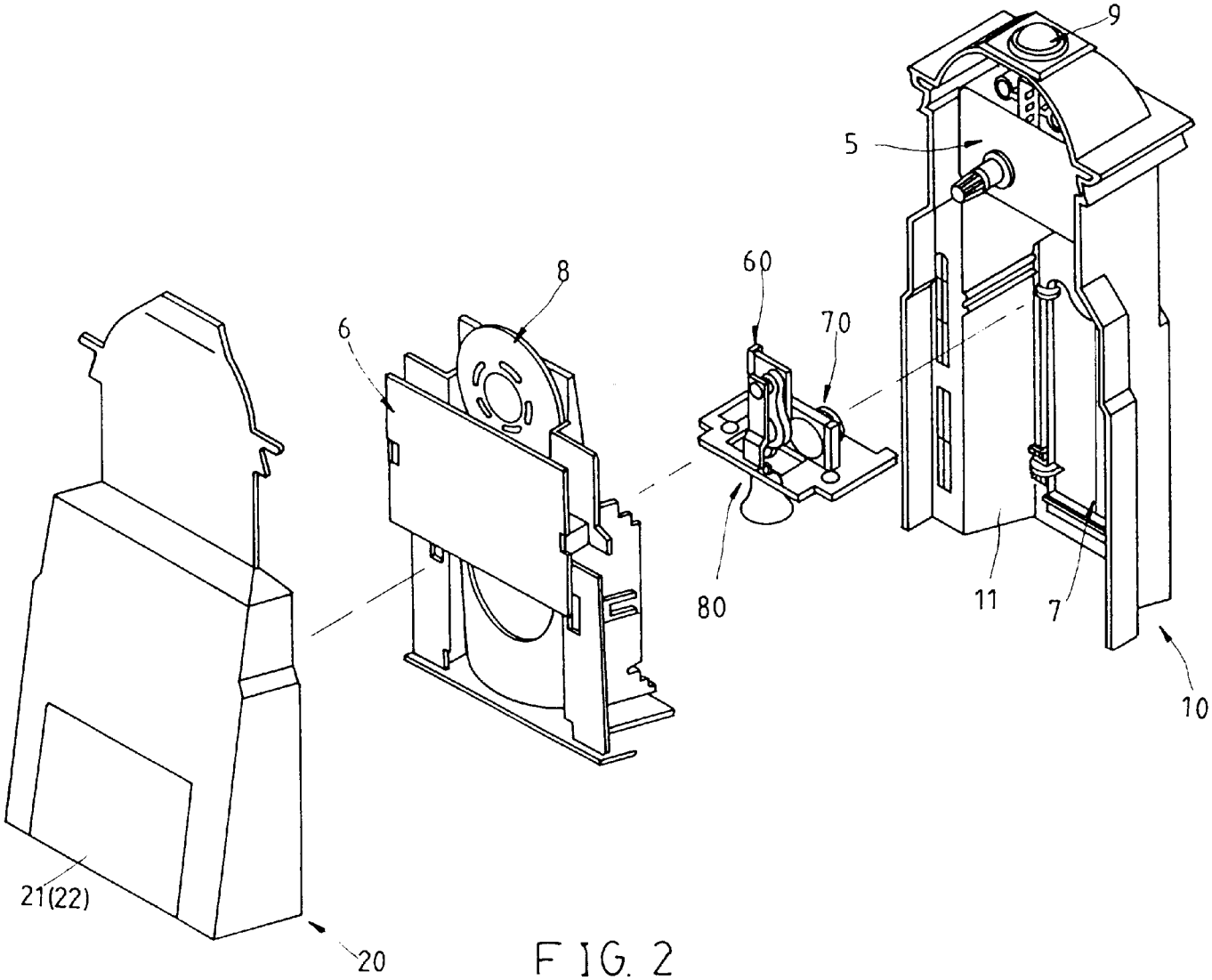
FIG. 2 shows an exploded view of the preferred embodiment of the present invention.
Figure 3:
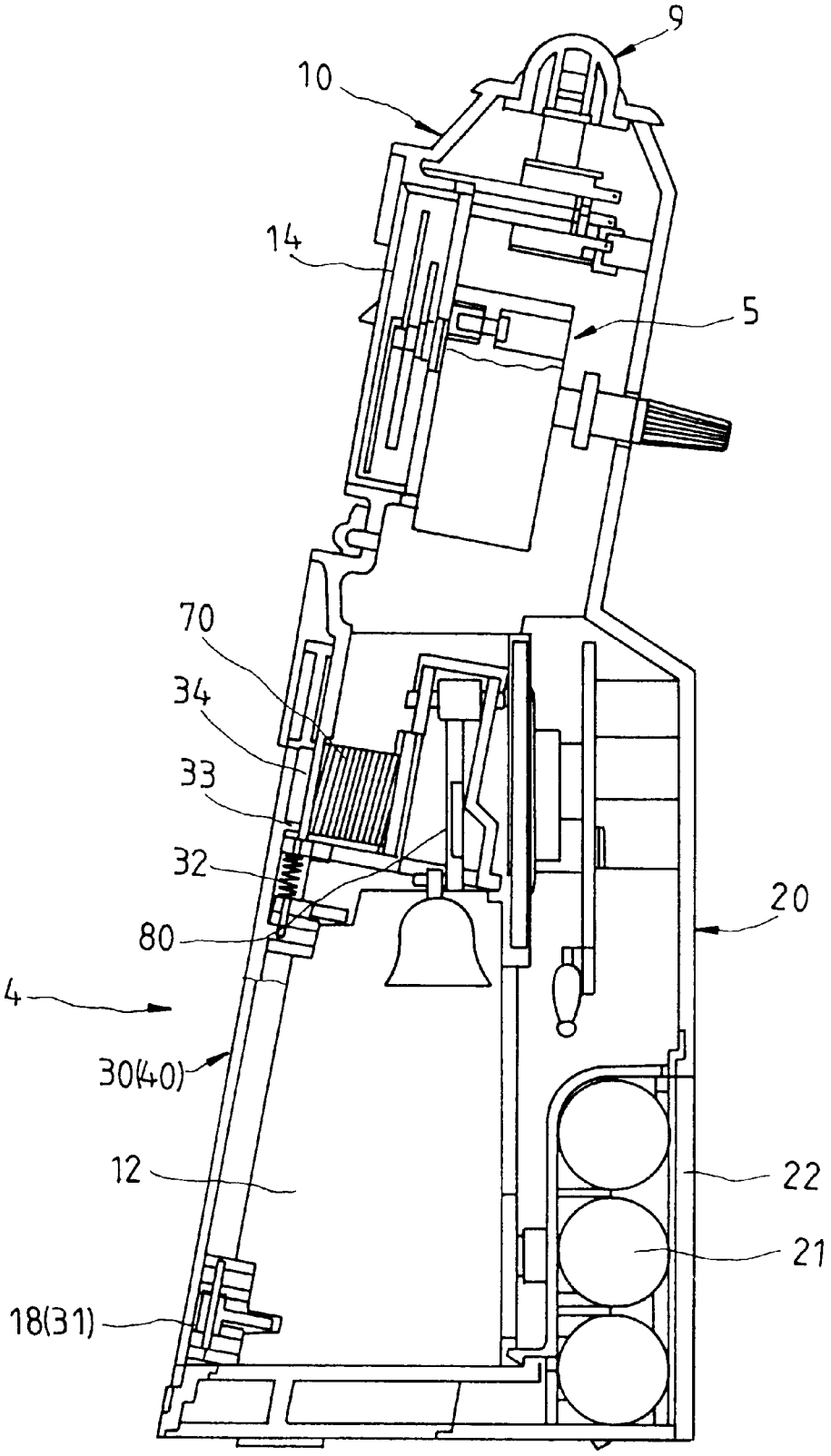
FIG. 3 shows a rear view of portion of component parts mounted on the front housing of the present invention.
Figure 4:
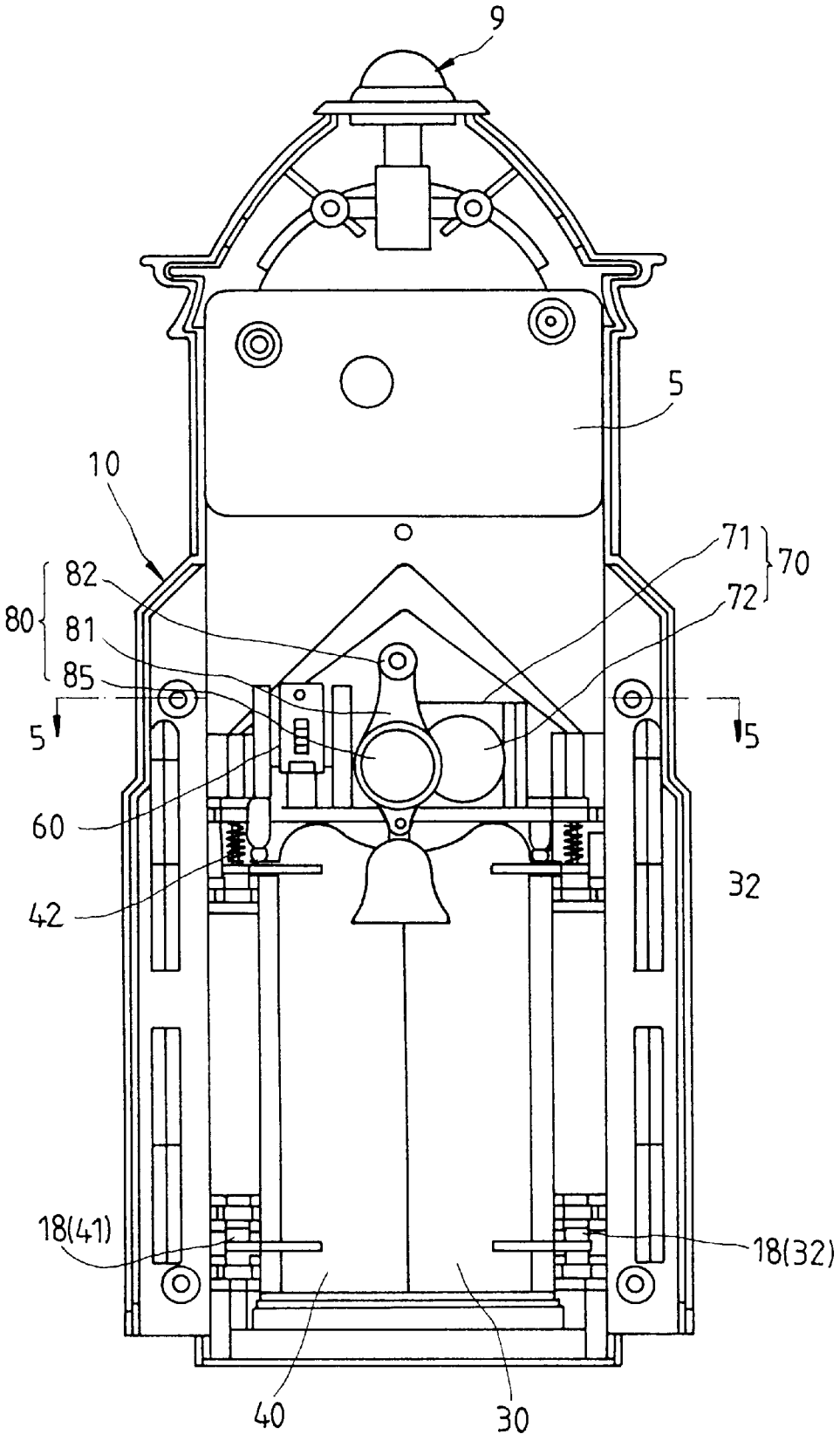
FIG. 4 shows a right sectional view of the preferred embodiment of the present invention.

As shown in FIGS. 1 and 2, an alarm clock 1 embodied in the present invention is composed of component parts which are described hereinafter.

A housing 2 is composed of a front housing 10 and a rear housing 20. The front housing 10 looks like the front of a church and has a chamber 11 located in the back thereof. An opening 13 is located in the lower half portion of the front housing 10. A clock dial face 14 is located in the upper half portion of the front housing 10. The front housing 10 is further provided with a through hole 15. The rear housing 20 is provided with a battery case 21 and a battery case cover 21.

A machine core 5 is mounted in the chamber 11 such that the machine core 5 is corresponding in location to the clock dial face 14.

A circuit unit 6 is disposed in the chamber 11 for controlling the power supply and the power interruption.

An opening and closing device 7 is located in the front side of the front housing 10 and composed of a left door 3 and a right door 40. The left door 30 has two pivoting portions 31 which are pivoted with two pivoting lugs 18, two springs 32 associated with the two pivoting portions 31, a protruded edge 33 corresponding in location to a magnetic sensor 70 of the front housing 10, and a magnet 34 disposed in the protruded edge 33. The right door 40 has two pivoting portions 41 which are pivoted with the pivoting lugs 18 of the front housing 10, two springs 42 associated with the pivoting portions 41, and an arresting rod 44 corresponding in location to the through hole 15 of the front housing 10.

A touch control set 60 is located in the chamber 11 of the front housing 10 such that the touch control set 60 is corresponding in location to the through hole 15. The touch control set 60 has a triggering rod 61 which is put through the through hole 15 of the front housing 10, a conductive elastic piece 62 which is fastened with the inner edge of the front housing 10, and a contact piece 63 which is disposed in the inner side of the triggering rod 61. The conductive elastic piece 62 and the contact piece 63 are connected with the circuit unit 6.

A magnetic sensor 70 is disposed in the chamber 11 such that the magnetic sensor 70 is corresponding in location to the magnet 34 of the left door 30. The magnetic sensor 70 has a relay 71, which is connected with the circuit unit 6. An electromagnet 72 is fastened with the front end of the relay 71.

An action unit 80 has an action member 81 and is provided at one end thereof with a pivot 82 which is pivoted with the front housing 10, and at other end thereof with a magnet 85. The action member 81 is capable of swiveling around the center of the pivot 82 so as to enable the magnet 85 to be at the corresponding position as the magnetic sensor 70.

The alarm clock 1 further comprises a loud speaker 8, which is disposed in the housing 2, and an interrupting switch 9, which is mounted on the top edge of the front housing 10 for controlling the buzzing and the acting of the alarm clock 1.

Figure 5:
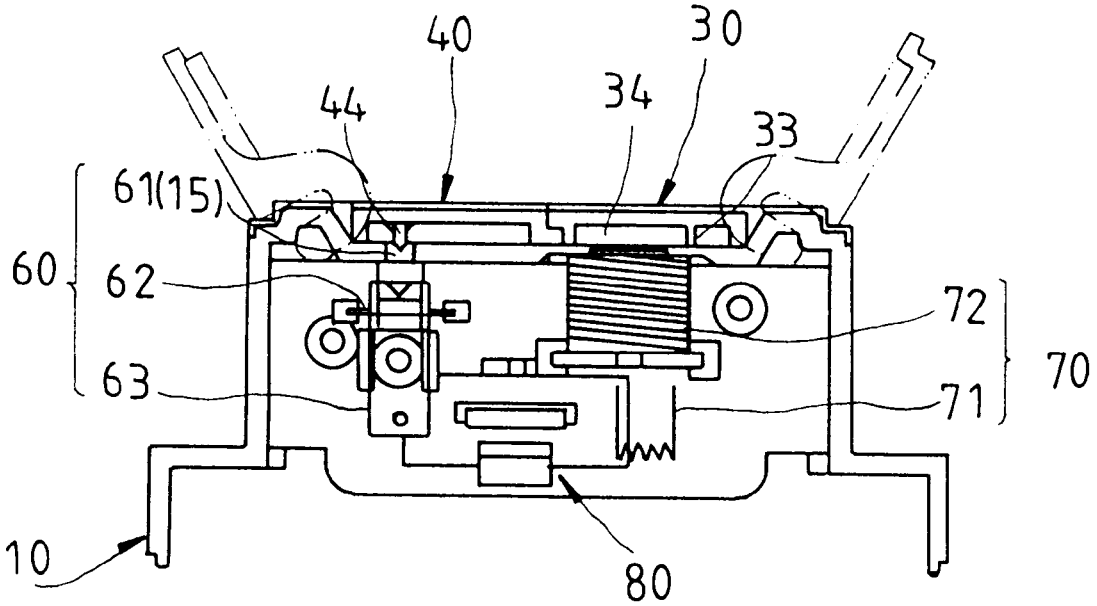
FIG. 5 shows a sectional view of a portion taken along the direction indicated by a line 5—5 as shown in FIG. 3.

As shown in FIG. 5 and other drawings provided herewith, when the left door 30 and the right door 40 remain closed, the arresting rod 44 of the right door 40 urges the triggering rod 61 of the touch control set 60 so as to force the conductive elastic piece 62 to make contact with the contact piece 63, thereby causing the circuit unit 6 to become connected with the SNOOZE loop and interrupting the power supply to the magnetic sensor 70. The magnet 34 of the left door 30 and the electromagnet 72 produce an attractive force greater than the elastic force of each of the springs 32 and 42. As a result, the left door 30 and the right door 40 remain shut.

The circuit unit 6 connects the magnetic sensor 70 with the power supply at a preset time to buzz, thereby enabling the relay 71 to bring about a magnetic current to cause the electromagnet 72 to produce a magnetic pole. The magnet 43 and the electromagnet 72 repel each other. As a result, the left door 30 and the right door 40 are opened up by the elastic force of the springs 32 and 42.

As the magnetic sensor 70 is continuously disconnected with the power source, the magnet 85 produces continuous attraction and release action, so as to cause the action member 81 to swing back and forth around the center of the pivot 82. As a result, the article (such as bell) carried by the action member 81 is actuated to swing. In the meantime, the circuit unit 6 connects the loud speaker 8 to produce a buzzing.

The opening 13 of the front housing 10 may be provided with a toy or lighting fixtures for flashing a light at any particular time when the left door 30 and the right door 40 are opened.

The present invention has the advantages, which are described hereinafter.

The alarm clock of the present invention has a unique swiveling unit in place of the conventional mechanical transmission.

The buzzing of the alarm clock of the present invention is controlled by the opening or closing action of the doors of the alarm clock.

The alarm clock of the present invention is simple in construction and capable of a precise operation.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An alarm clock comprising:

a housing provided with a chamber;

a machine core disposed in said chamber of said housing;

a loud speaker disposed in said chamber of said housing;

a circuit unit disposed in said chamber of said housing;

an opening and closing device having at least one door pivoted to said housing, a magnet and an arresting rod pivoted to said door;

a touch control set disposed in said housing such that said touch control set is opposite in location to said arresting rod, and that said touch control set is connected with said circuit unit;

a magnetic sensor disposed in said housing such that said magnetic sensor is opposite in location to said magnet, said magnetic sensor having a relay which is connected with said circuit unit, and an electromagnet disposed in said relay; and an action unit disposed in said housing;

wherein said action unit comprises an action member and a magnet, said action member having a pivot located at one end thereof, said magnet being mounted at other end of said action member, said action member capable of turning around a center of said pivot such that said magnet is corresponding in location to said magnetic sensor;

wherein said circuit unit is connected with power supply to remain in SNOOZE state such that said magnetic sensor is disconnected with power supply at the time when said touch control set is pressed by said arresting rod;

wherein said circuit unit connects said magnetic sensor with power supply such that said magnetic sensor produces a magnetic field to repel said magnet to open up said door and bring about a buzzing at a time preset in said machine core;

wherein said circuit unit disconnects said magnetic sensor with power supply such that said magnetic sensor produces a continuous attraction and release action to said magnet, and that said action member swivels back and forth around said center of said pivot.

2. The alarm clock as defined in claim 1, wherein said door and said housing are provided therebetween with a torsion spring fastened pivotally thereto.

3. The alarm clock as defined in claim 2, wherein said housing is provided with an interrupting switch for controlling the buzzing and the action of said machine core.

4. The alarm clock as defined in claim 1 further comprising a predetermined number of toys disposed in said chamber of said housing.

5. The alarm clock as defined in claim 1, wherein said opening and closing device has a left door and a right door.

6. The alarm clock as defined in claim 1, wherein said housing is formed of a front housing and a rear housing.

* * * * *